US005865316A

United States Patent [19]

Smith

[11] Patent Number: 5,865,316

[45] Date of Patent: Feb. 2, 1999

[54] MULTI-FOOD DISPLAY TOWER WITH INTERCONNECTING FOOD BIN

[75] Inventor: Michael J. Smith, Orangeburg, N.Y.

[73] Assignee: Arrow Art Finishers, L.L.C., Bronx, N.Y.

[21] Appl. No.: 918,030

[22] Filed: Aug. 25, 1997

[51] Int. Cl.[6] ..... B65D 25/54

[52] U.S. Cl. ..... 206/775; 206/775; 206/503; 206/512; 206/764; 220/4.26

[58] Field of Search ..... 220/4.26, 4.27, 220/24.83; 206/511, 512, 503, 775, 782, 776, 777, 216, 509, 738, 739, 745, 746, 756, 764, 45.24, 45.25, 45.27

[56] References Cited

U.S. PATENT DOCUMENTS

| | | | |
|---|---|---|---|
| 3,656,611 | 4/1972 | Mertz | 206/764 |
| 3,904,066 | 9/1975 | Wilson | 206/512 |
| 3,918,576 | 11/1975 | Taub | 206/764 |
| 4,053,098 | 10/1977 | Baptist | 206/512 |
| 4,191,288 | 3/1980 | Hostad | 206/764 |
| 4,591,047 | 5/1986 | March | 206/738 |

FOREIGN PATENT DOCUMENTS

| | | | |
|---|---|---|---|
| 219-176 | 4/1987 | European Pat. Off. | 206/45.24 |

*Primary Examiner*—Paul T. Sewell
*Assistant Examiner*—Jila Mohandesi
*Attorney, Agent, or Firm*—Kirschstein et al.

[57] ABSTRACT

A display stand for displaying at least two types of food items includes a lower and an upper display component, each for accommodating a plurality of soft-packaged items, and a tray component for receiving a plurality of hard-packaged items. Each lower and upper component has an opening through which the soft-packaged items are visible and removable. The tray component is located between the upper and lower components and has a front opening through which the hard-packaged items are visible and removable. The tray component has an extension projecting beyond the general outline of the display stand as defined by the peripheries of the lower and upper components.

16 Claims, 3 Drawing Sheets

10
14
13
50
12
60
6
6
39
11
50

13
35
36
38
37
30
26
12
24
20
17
27
15

MULTI-FOOD DISPLAY TOWER WITH INTERCONNECTING FOOD BIN

BACKGROUND OF THE INVENTION

1. Field of the Invention

The present invention relates to display stands in general, and more particularly to display towers or stacks capable of displaying more than one kind of food goods or items.

2. Description of the Related Art

There are already known various constructions of display arrangements, among them such that are commonly referred to as display towers, racks or stacks. Devices of this kind are usually used as stand-alone, but not permanent, display structures in grocery stores or other retail establishments, ordinarily being placed into the aisles present between the permanent shelf or similar structures, and are made of a material, such as corrugated board or cardboard, that is much less sturdy (and hence much less expensive) than the materials used for the construction of such permanent structures. Moreover, such devices often are not even unitary; rather, each of them consists of a number of interconnected discrete components that are, for instance, superimposed on one another.

In one known implementation of this approach to the displaying of items being offered for purchase, each of a plurality of display components is provided with one type of locking formation (i.e., either male or protruding or female and receding) at, say, its bottom, and the other type of locking formation at corresponding zones of its top so that, when one such component is stacked on top of another, such formations get into a complementary relationship with respect to one another (i.e., the male protrusions enter and substantially fill the female recesses) and henceforth hold the two components in their thus established stacked or superimposed relationship even if the display stand is exposed to that kind of forces (bumps or the like) that are to be expected in a crowded retail establishment.

Arrangements of this type perform reasonably well and have even enjoyed a modicum of success when only one type of an item was to be displayed in the particular arrangement. However, there are situations where it is desired to display two or more kinds of items, especially food, that are usually somehow intrinsically related to one another, for example, by being eaten together, in close physical proximity to one another. Good examples of such items are tortilla chips and salsa sauce: they go well with one another and are often purchased at the same time.

Hence, to save the customers bent on purchasing such items the trip and the time required for looking them up in different aisles of the retail establishment (and/or the possible embarrassment of coming back from a shopping trip with one and not the other of them), it has been previously proposed to co-locate the salsa sauce containers or the like with the tortilla chip or similar packages. One way of doing that was to use a separate holding receptacle for such containers, and attach that separate receptacle to (for instance, hang it on) the display rack or stack accommodating the chip bags.

It will be appreciated, though, that this was not an ideal solution; as a matter of fact, it left much to be desired, particularly because the attachment of the separate receptacle to the rack, given the very nature of these structures, could not possibly have been strong and permanent enough to be able to withstand all the jostling to which it may be subjected in a busy retail establishment. Given the fragile nature of the salsa containers or the like, dissociation of the receptacle containing them from the display stand or rack could result not only in embarrassment to the person knocking it off but also rather considerable damage and mess to be cleaned by the store personnel. This, of course, is highly undesirable.

OBJECTS OF THE INVENTION

Accordingly, it is a general object of the present invention to avoid the disadvantages of the prior art.

More particularly, it is an object of the present invention to provide a display stand that does not possess the drawbacks of the known display stands of this type.

Still another object of the present invention is to devise a display stand of the type here under consideration which is capable of displaying two types of disparate yet interrelated items, especially food, in close proximity to one another in an integrated manner.

It is yet another object of the present invention to design the above display stand in such a manner as to be highly resistant to disintegration or disassembly in response to forces that are incident to the operation of and frequently encountered in a retail establishment.

A concomitant object of the present invention is so to construct the display stand of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a display stand for displaying at least two types of disparate and yet intrinsically interrelated items. According to the invention, the display stand includes at least one first component for accommodating a plurality of the items of one type, at least one second component for receiving a multitude of the items of another type, the second component being located, when the display stand is in its use condition, on top of the first component and being at least coextensive therewith as far as its horizontal cross section is concerned, and means for connecting the first and second components with each other in the use condition of the display stand.

The first component has walls bounding an interior in which the items of one type are accommodated. At least one of these walls has an opening through which these items are visible and accessible. Preferably, these items are soft-packaged bags containing chips. The second component also has walls bounding an interior in which the items of the other type are accommodated. The second component has a front opening through which these other items are visible and accessible. Preferably, these other items are hard-packaged containers containing a sauce or dip.

A particular advantage of the display stand as described so far is that, owing to the fact that the second component is at least coextensive with the first component, the likelihood of its being knocked off accidentally is reduced to a minimum, if not eliminated, altogether. According to another advantageous aspect of the present invention, the display stand further includes at least one third component similar to the first component and situated on top of the second component in the use condition of the display stand. There is further provided additional connecting means similar to the first-mentioned connecting means and operative for connecting the third component to the second component in the use condition of the display stand. This measure further increases the stability of the display stand in that the second component is now confined between the first and third components and hence is firmly held in place by them.

This renders it possible to incorporate in the display stand another advantageous feature of the present invention, namely to provide the second component with an extension projecting beyond the general outline of the display stand as defined by the peripheries of the first and third components, without sacrificing the stability of the display stand or risking dissociation of the second component (the one containing the fragile glass containers) from the rest of the display stand. In this context, it is particularly advantageous for the two oppositely located side walls of the second component to extend into the extension and for their upper edges to taper downwardly within the extension with increasing distance from the peripheries of the first and third components to facilitate access to and maneuvering with the items of the other type.

Another facet of the present invention can be found in the additional connecting means including respective L-shaped tabs situated at respective upper corner regions of the second component and peripherally delimiting an area. In that case, it is proposed in accordance with the present invention to provide the second component with at least one top wall horizontally spanning the aforementioned area as considered in the use condition, and to form the third component with a lower region that is substantially snugly received in the thus delimited area and rests on the top wall of the second component in the use condition of the display stand. In this context, it is particularly advantageous when the top wall of the second component includes two ledge wall portions separated from one another by a gap extending transversely of the display stand as considered in the use condition, and when the stand further includes an auxiliary wall connected with, and extending downwardly from, one of the ledge portions and delimiting a space within the second component that is devoid of the items of the other type.

Last but not least, it is advantageous for the first-mentioned connecting means to include respective L-shaped tabs situated at respective upper corner regions of the first component, and correspondingly shaped and distributed slots in the second component for receiving the tabs in the use condition of the display stand.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
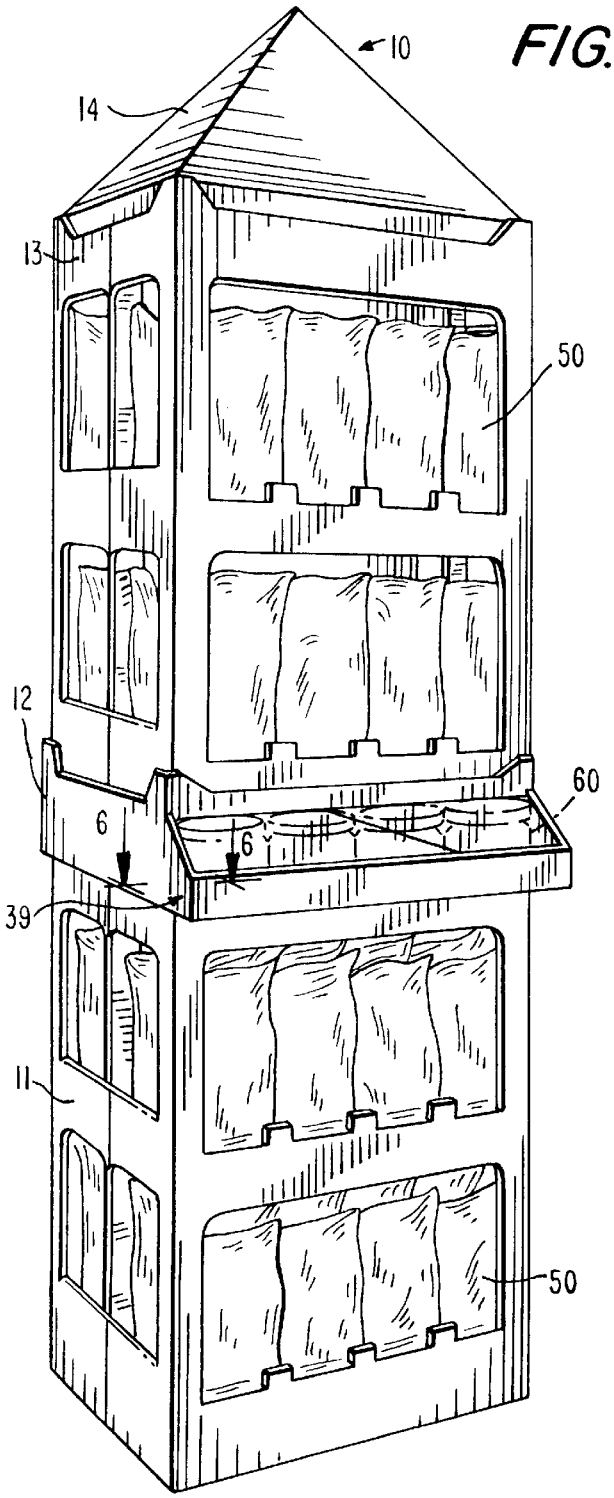
FIG. 1 is a perspective view of a display stand embodying the present invention.

Referring now to the drawing in detail, and first to FIG. 1 thereof, it may be seen that the reference numeral 10 has been used therein to identify a display stand of the present invention. The display stand 10 is made of corrugated board, cardboard or a similar relatively rigid yet flexible or malleable material, and is designed for holding on display for purchase in a retail store or a similar establishment at least two kinds of items. In general, these item types may be totally disparate and unrelated; however, the present invention has been developed for a situation where the types of the (as shown, just two) items are, while still different, related to one another in one way or another, for instance in that their contents are to be consumed together, like tortilla chips and salsa sauce, or potato chips and cheese dip, are; therefore, the present invention will be described below in this context, although it will be expressly understood that the present invention is not intended to be limited to such foodstuffs.

As may be observed particularly in FIG. 1 of the drawing, the display stand includes a plurality of components that are stacked on top of one another. As shown, these components include a lower or base component 11, an intermediate or intermediary component 12, an upper component 13, and a top or closing component 14.

The lower component 11 has walls, preferably four, bounding an interior in which the items of one type are accommodated. At least one of these walls has an opening through which these items of one type are visible and accessible. Preferably, these items are soft-packaged bags containing chips.

The upper component 13 has walls, also preferably four, bounding an interior in which the items of the same one type are accommodated. At least one of these walls has an opening through which these items of one type are visible and accessible. Preferably, these items are the same soft-packaged bags containing chips.

The intermediate component 12 also has walls bounding an interior in which the items of the other type are accommodated. The intermediate component 12 has a front opening through which these other items are visible and accessible. Preferably, these other items are hard-packaged containers containing a sauce or dip.

The top component 14, shown to possess a pyramidal shape, serves, by and large, an aesthetic or decorative purpose (albeit also providing some reinforcement for the upper region of the upper component 13) and, therefore, could be dispensed with. While the other components 11 to 13 could, at least theoretically, be used on their own (with each of them being located at a distance from the others and possibly even at a different area of the establishment), the very purpose of the present invention would be defeated if that was done; in other words, at least the bottom component 11 and the intermediate component 12 should be used in their superimposed relationship revealed in FIG. 1 in order to live up to the spirit and promise of the present invention.

On the other hand, there is no upper limit (except for that dictated by practical considerations) on the number of the components 12 and 13 that are stacked on top of the assembly of the lower component 11 with the associated intermediate component 12, with the additional intermediate component(s), if any, being in each instance situated on top of the preceding top component 13, however. The reason for this latter limitation is that the intermediate component 12 is configured to cooperate with (engage) the corresponding regions of the components 11 and 13, but not with those of another one of the intermediate components 12. This will become more apparent from considering the remaining Figures of the drawing.

Figure 2:
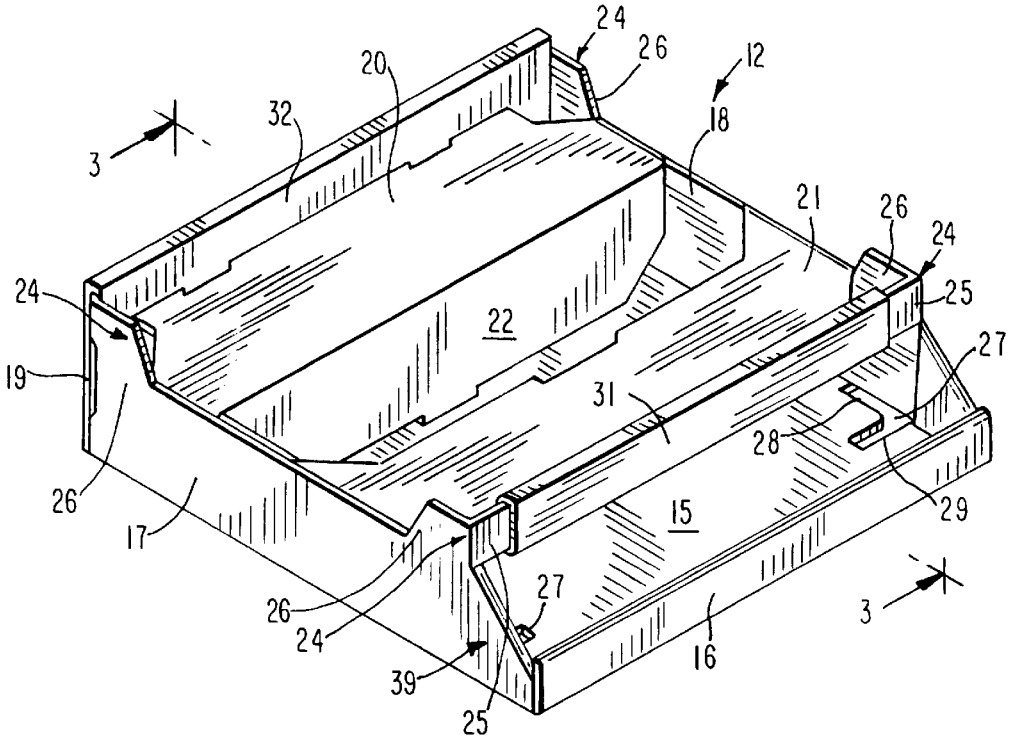
FIG. 2 is a perspective view of an intermediate component of the display stand illustrated on a somewhat smaller scale in FIG. 1.

However, before addressing this cooperative interengagement of the various components 11 to 13 of the display stand 10, it would behoove us to turn our attention to FIG. 2 of the drawing and consider the details of construction of the intermediate component 12 that are depicted there. To be able to serve as a food bin, tray or receptacle, the intermediate component 12 has, as previously mentioned, a plurality of walls, among them a bottom wall 15, a front wall 16, two side walls 17 and 18, and a rear wall 19.

In addition, the intermediate component 12 is shown to include two ledge walls 20 and 21 that, as will become clear later, serve as a support—and in the illustrated example also, as a bottom wall—for the upper component 13. The ledge walls 20 and 21 are supported at their respective side regions on the associated side walls 17 and 18. Moreover, the ledge walls 20 and 21 are also supported, in a manner yet to be described, on the rear and front walls 19 and 16, respectively.

In addition to that, a region of the ledge wall 20 that is located remotely from the rear wall 19 is supported on the bottom wall 15 by means of a vertical support wall 22. It ought to be mentioned at this juncture that the walls 20 to 22 are basically complementary to one another, that is, they would form a complete "auxiliary wall" if located in one and the same plane (as they originally were). The fact is, though, that the support wall 22 is displaced out of the plane of the ledge walls 20 and 21 (in fact, it extends substantially perpendicularly to that plane), which makes the aforementioned "auxiliary wall" (i.e., the bottom wall for the upper component 13) incomplete.

This, however, is of no serious consequence in most applications, especially the one contemplated here, as will be explained below. However, if the presence of a "hole" in the substitute "bottom wall" 20, 21 for the upper component 13 were to be a problem (for instance, if relatively small items were to be accommodated in the upper component 13, or if the upper component 13 were to be transported prepacked with the respective items), a simple remedy would be to provide the upper component 13 with a bottom wall of its own. In that case, the ledge walls 20 and 21 would still be present (and so would the support wall 22), but in that event they would only serve the purpose of supporting the upper component 13 (but not directly the items contained in it) from below.

Figure 3:
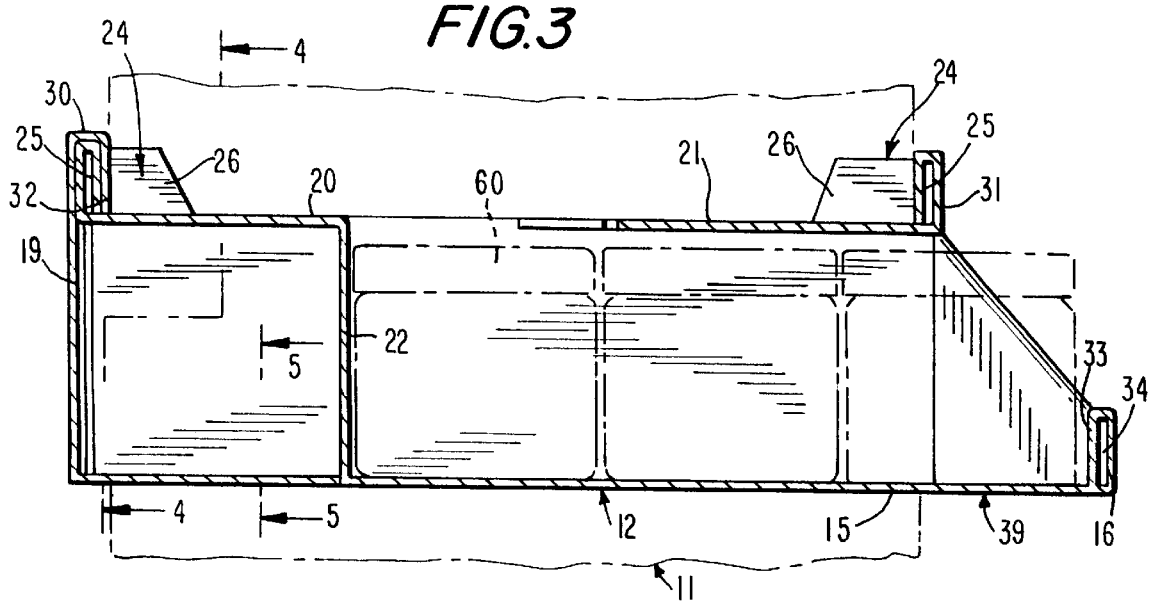
FIG. 3 is a sectional view through the intermediate component taken in a plane indicated in FIG. 2 by arrows 3—3.

As will be seen from a comparison of FIGS. 2 and 3 with one another, the intermediate component 12 is provided, at its upper corner regions, with respective male locking formations or tabs that are all identified, regardless of their respective locations, by the same reference numeral 24. Morever, the bottom wall 15 is provided at similar, but not necessarily identical, regions thereof with respective female locking formations which again have all been identified by a common reference number 27, irrespective of where they are situated.

Each of the tabs 24 is generally L-shaped, that is, it includes two legs 25 and 26 that extend essentially normal to each other (i.e., substantially coplanarly with the respective front, side and rear walls 16 to 19). It ought to be realized that the legs 25, even though extending along respective common planes, are still separate from each other, i.e., there is a discontinuity (gap) between them. To better hold them in place and further reinforce the intermediate component 12 by providing the aforementioned rear and front support for the ledge walls 20 and 21, respective portions 30 and 31 of the ledge walls 20 and 21 are wrapped around these legs 25 and locked in place, at least as far as the portion 31 is concerned, by means of respective noses engaging in corresponding slots of the ledge wall 21 (and/or the ledge wall 20). Inasmuch as such the elements providing such locking action are well known to those familiar with the art of designing packaging boxes and/or display stands of the kind here under consideration, no references have been assigned to them or their "cousins" yet to be mentioned.

As far as the portion 30 is concerned, it may be surrounded, as shown, by a region 32 of the rear wall 19; in this case, the region 30 of the ledge wall 20 need not be provided with the nose/slot interengagement formations, especially when the region 32 of the rear wall 19 is provided with their "cousins", as indicated in FIG. 2 of the drawing. It also ought to be mentioned at this juncture that other such "cousins" are provided on the support wall 22 and in the bottom wall 15, as also visible in FIG. 2, as well as in FIG. 3. Last but not least, it is to be mentioned in this context that the bottom wall 15 of the intermediate component 12 is provided with a region 33 which, similarly to what has been described before, is wrapped around respective tabs or extensions of the side walls 17 and 18 (and preferably locked in place by the cooperation of other such "cousins").

Now that the basic construction of the intermediate component 12 has been described in some detail, the cooperation of the component 12 with the components 11 and 13 will be discussed next, first with reference to FIG. 4 as viewed in conjunction with FIG. 3. It may be seen there that the lower region of the upper component 13 is received (quite snugly) within the region of the intermediate component 12 that is delimited at the corners by the respective male locking formations 24 and at the front and rear by the bent-over and locked regions 30 and 32 (or 31 in the absence of the latter), respectively. This kind of interaction, of course, assures that the upper component 13 cannot simply slide off of the intermediate component 12 in response to application of ever so slight forces, such as those occurring when a customer, a store employee, or a shopping cart accidentally brushes against the display stand 10, an occurrence that is not all that uncommon.

Figure 4:
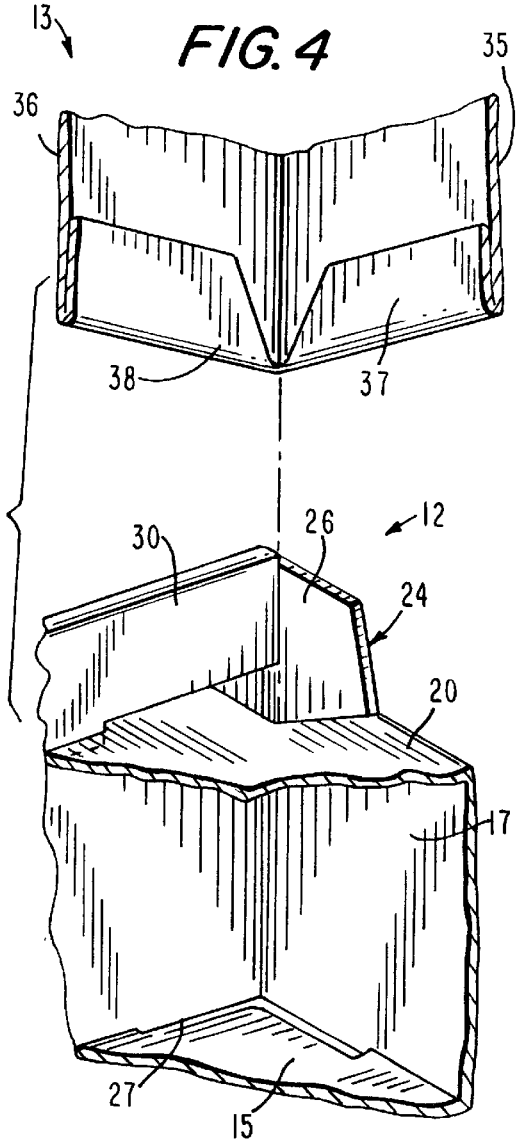
FIG. 4 is a fragmentary view on an enlarged scale of a corner region of the display stand of the present invention as indicated generally by a line 4—4 of FIG. 3, showing an upper component in a bottom perspective and the intermediate component in a top perspective.

It may also be observed in FIG. 4 that, in the illustrated embodiment, the upper component 13 is indeed "bottomless", as alluded to before, that is, that it does not have its own bottom wall. Rather, respective walls 35 and 36 of the upper component 13 are shown to be terminated at their lower ends by respective flaps 37 and 38 that are bent backwards to positions parallel to their "originating" walls, being possibly (but not necessarily) secured to them, for instance by stapling or glueing.

A particular reason why the upper component 13 can get by without its own bottom wall is that it is intended to be used for accommodating items with relatively low specific density and weight, such as bags 50 of potato or tortilla chips or the like as shown in FIG. 1. Incidentally, as also shown there, the lower component 11 may be used to accommodate the same kind of items 50. On the other hand, the intermediate member 12 is intended to hold items 60 with relatively high specific density and hence relatively heavy, such as bottles or similar receptacles containing salsa sauce, cheese dip or the like; hence the need for all of the reinforcements (wrap-around walls 30 to 33 and the like) mentioned before, not to speak about the provision of the bottom wall 15. Of course, if a bottom wall is desired for the upper component, it can be provided at the very bottom end thereof, or spaced slightly above the flaps 37 and 38.

To make the items 60 not only visible but also accessible and removable through the front of the intermediate component with relative ease, the intermediate component 12 extends, as may be seen particularly in FIG. 1 of the drawing, frontwardly beyond the general outline of the display stand 10 as defined by the upper and lower components 13 and 11, forming an extension 39. It may also be seen (especially in FIG. 2) that the side walls 17 and 18 are generally trapezoidally shaped within the region of the extension 39, thus giving lateral (in addition to frontal) access to the items 60 for the prospective purchaser to be better able to engage them during removal from the intermediate component 12.

Figure 5:
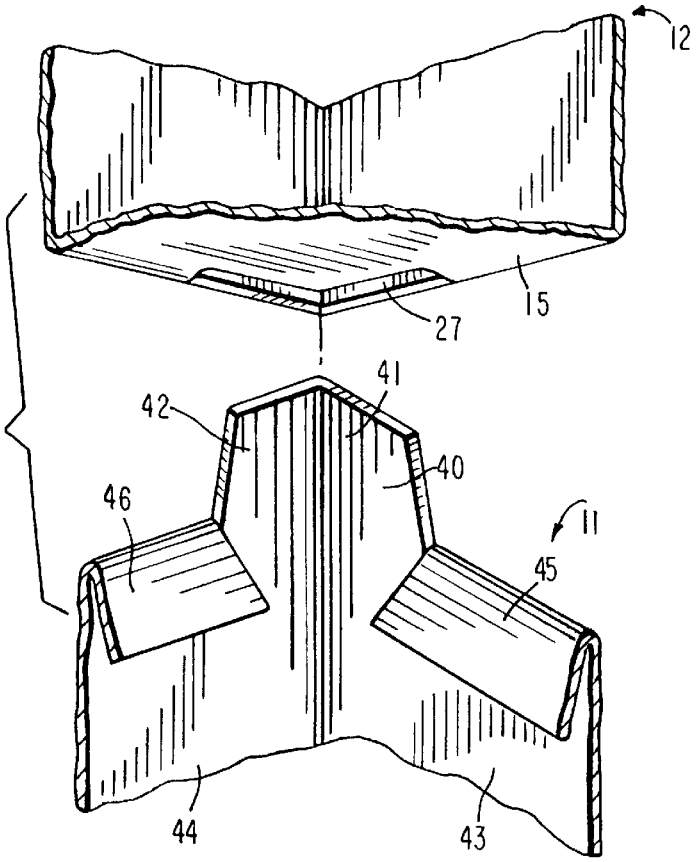
FIG. 5 is a view similar to that of FIG. 4 but taken on line 5—5 of FIG. 3 and showing the intermediate component in a bottom perspective and a lower component of the display stand of FIG. 1 in a top perspective.
Figure 6:
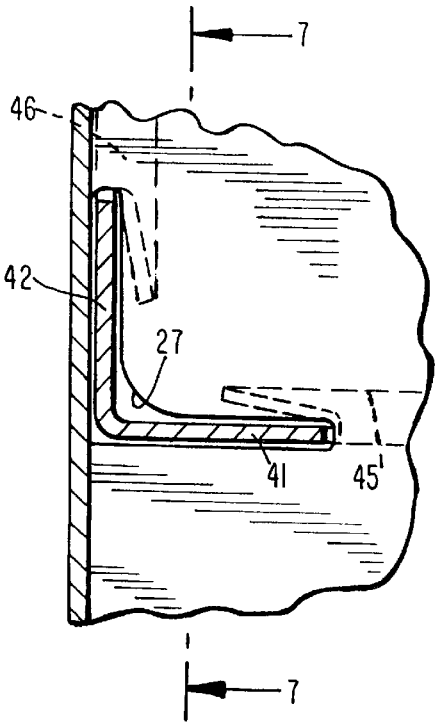
FIG. 6 is a sectional view, again on an enlarged scale, through another corner region of the display stand, taken in a plane indicated at 6—6 in FIG. 1.
Figure 7:
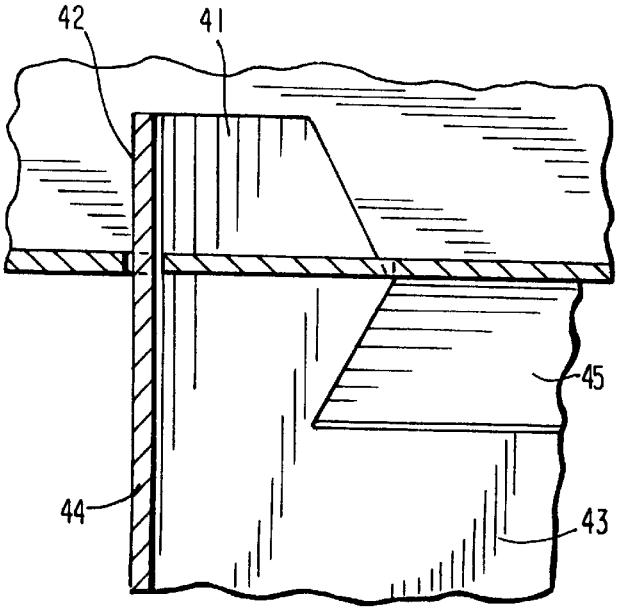
FIG. 7 is yet another sectional view taken on line 7—7 of FIG. 6.

FIG. 5 of the drawing illustrates, in general terms, how the intermediate component 12 is secured to the upper region of the lower component 11, again in a manner preventing the accidental sliding off, this time of the intermediate component 12 from the lower component 11. To this end, the lower component 11 is provided at its respective upper corner regions with respective male locking formations which, once more, have been designated by the same reference numeral 40 regardless of their positions. This convention will also apply throughout the rest of this description in that corresponding parts will bear the same reference numerals. As may be surmised from FIG. 5 and definitely ascertained from FIGS. 6 and 7 (which show a different corner of the stand 10, though) the respective male locking formation 40, which again is basically L-shaped in that it has two generally orthogonally extending legs 41 and 42, is introduced into and received (with a minimum amount of leeway, if any) in the female locking formation or recess 27. To facilitate the introduction of the male formations 40 into the female formations 27, the former are given generally trapezoidal (i.e., upwardly narrowing) configurations.

The male formations 40, that is, their legs 41 and 42, are formed from respective walls 43 and 44 of the lower component 11. Adjacent regions 45 and 46 that are separated from the legs 41 and 42 during this formation process are not severed from the walls 43 and 44 of their origin altogether, though; rather, they remain attached to them and are merely bent downwardly to form slightly enlarged bases for those associated regions of the bottom wall 15 of the intermediate component 12 that come to rest on them upon assembly.

Turning back for the last time to FIG. 3 of the drawing, it is to be mentioned that the support wall 22, besides performing the aforementioned supporting function for the ledge wall 20, and, in turn, acting as a support for the entire upper component 13, also serves another, and possibly even more important, purpose: it constitutes a "false" back wall for the items or containers 60. The reasoning behind this feature of the present invention is that, given the relatively small height of the intermediate component 12 (which is dictated by the relatively small height of the containers 60), it would be very difficult, if not impossible, to remove those of the items 60 that are all the way in the back; hence, the tendency of the customers and store clerks alike would be to leave these items 60 there, possibly well past their expiration date. The presence of the "backing" wall 22 avoids this situation, because it creates a void in the region where such "unreachable" items 60 would otherwise be present.

It will be understood that each of the elements described above, or two or more together, may also find a useful application in other types of constructions differing from the type described above.

While the present invention has been described and illustrated herein as embodied in a specific construction of a display stand for displaying two types of intrinsically interrelated items in close proximity to one another, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A display stand for displaying items, comprising:

a) a lower display component having lower walls bounding an interior for accommodating a first plurality of the items, at least one of the lower walls having at least one first opening through which the first plurality of the items accommodated on the lower display component are visible and removable, said lower display component having upper regions;

b) an intermediate display tray component mounted on the upper regions of the lower display component and having tray walls bounding an interior for accommodating a second plurality of the items, said tray walls including a pair of side walls extending past said at least one of the lower walls and bounding a second opening through which the second plurality of the items accommodated on the tray component are visible and removable; and c) an upper display component having upper walls bounding an interior for accommodating a third plurality of the items, at least one of the upper walls having at least one third opening through which the third plurality of the items accommodated on the upper display component are visible and removable, said upper display component having lower regions mounted on the tray component.

2. The display stand as defined in claim 1, wherein there are four of said lower walls and four of said upper walls, each of the lower and upper display components having a four-sided configuration.

3. The display stand as defined in claim 1, wherein said at least one of the lower walls is co-planar with said at least one of the upper walls.

4. The display stand as defined in claim 1, wherein said at least one of the lower walls has a plurality of first openings, and wherein said at least one of the upper walls has a plurality of third openings.

5. The display stand as defined in claim 1, wherein the lower walls have multiple first openings, and wherein the upper walls have multiple third openings.

6. The display stand as defined in claim 1, and further comprising a top display component mounted on the upper display component and having top walls that converge toward one another in a direction away from the upper display component.

7. The display stand as defined in claim 1, wherein each component is constituted of a corrugated board material.

8. The display stand as defined in claim 1, wherein the tray walls include a bottom wall on which the second plurality of the items are supported, said bottom wall having slots; and wherein the upper regions of the lower display component have upright tabs that extend through the slots.

9. The display stand as defined in claim 8, wherein each tab and each slot has an L-shaped configuration.

10. The display stand as defined in claim 1, wherein said at least one of the lower walls and said at least one of the upper walls lie in a common plane; and wherein the tray walls include a front wall which is located in a front plane that is forwardly spaced from, and generally parallel to, the common plane.

11. The display stand as defined in claim 10, wherein the side walls extend and are connected to opposite end regions of the front wall, said side walls having upper edges that taper downwardly from the side walls to the front wall.

12. The display stand as defined in claim 10, wherein the side walls have a predetermined height, and wherein the front wall has a reduced height less than said predetermined height.

13. The display stand as defined in claim 8, wherein the tray walls include a bottom wall on which the second plurality of the items are supported, and a ledge wall spaced upwardly from the bottom wall; and wherein the lower regions of the upper display component are mounted on the ledge wall.

14. The display stand as defined in claim 13, wherein the tray walls include corner regions extending upwardly from the ledge wall and snugly receiving the lower regions of the upper display component.

15. The display stand as defined in claim 13, wherein the ledge wall includes a pair of ledge wall portions spaced apart from each other, and wherein one of the ledge wall portions has an auxiliary wall portion connected with and extending downwardly from said one of the ledge wall portions.

16. The display stand as defined in claim 15, wherein the tray walls include a rear wall and a front wall spaced apart from each other, and wherein the auxiliary wall portion is located intermediate the rear and front walls.

* * * * *